US005786045A

United States Patent [19]

Gerth et al.

[11] Patent Number: 5,786,045

[45] Date of Patent: Jul. 28, 1998

[54] COMBINATION LOG-SET SYSTEM

[75] Inventors: Fred B. Gerth, La Mirada; Sasan Farajian, Long Beach; Mikhail Alpert, Los Angeles, all of Calif.

[73] Assignee: Marco Manufacturing, Inc., Lynwood, Calif.

[21] Appl. No.: 673,300

[22] Filed: Jun. 28, 1996

[51] Int. Cl.[6] ..... B44F 9/04; F24C 3/02

[52] U.S. Cl. ..... 428/15; 156/60; 156/61; 428/18

[58] Field of Search ..... 428/15–18; 156/60–61

[56] References Cited

U.S. PATENT DOCUMENTS

| | | | |
|---|---|---|---|
| 4,875,464 | 10/1989 | Shimek et al. | 126/92 R |
| 5,000,162 | 3/1991 | Shimek et al. | 431/125 X |
| 5,026,579 | 6/1991 | Thow | 428/15 |
| 5,052,370 | 10/1991 | Karabin | 126/92 R |
| 5,081,981 | 1/1992 | Beal | 126/92 R |
| 5,114,336 | 5/1992 | Karabin et al. | 431/125 |
| 5,284,686 | 2/1994 | Thow | 428/15 |
| 5,392,763 | 2/1995 | Shaw et al. | 431/125 X |

*Primary Examiner*—Henry F. Epstein

*Attorney, Agent, or Firm*—Blakely Sokoloff Taylor & Zafman

[57] ABSTRACT

An artificial log assembly is disclosed. The artificial log assembly includes first and second concrete portions and a ceramic portion disposed between the first and second concrete portions. The concrete portions are easily and economically formed to an appearance of natural firewood, and the ceramic portion provides a "glowing effect" of burning embers when heated. Also disclosed is a log assembly system utilizing dual gas burners of different flame temperatures.

11 Claims, 6 Drawing Sheets

COMBINATION LOG-SET SYSTEM

BACKGROUND OF THE INVENTION

1. Field of the Invention

The invention relates to gas-burning fireplaces or stoves and more particularly to artificial log sets that emulate a wood-burning fire.

2. Background of the Invention

Fireplaces and stoves are common elements of many homes. They provide heat and aesthetic qualities. Traditional fireplaces and stoves are fueled by the addition of wood, i.e., tree pieces or logs, that have been ignited by flame. The firewood burns and gives off heat, then disintegrates into ash. The ash is then removed from the fireplace or oven and discarded. More modern approaches to fueling fireplaces and stoves involve supplying a gas source to the fireplace or stove as a cleaner burning alternative requiring no refueling or ash removal. Artificial logs are used to impart a realistic look to a gas-fired fireplace or stove.

Artificial logs are typically made of a refractory material that is impervious to hot flames and high temperatures. Concrete is a suitable refractory material from which to make artificial logs. Concrete is inexpensive and easily formable so it provides an economical means to produce highly defined details in logs or log sets to simulate natural wood. Concrete is also excellent for radiating heat from the fireplace or stove to the surrounding areas. The drawback of using concrete, however, is its inability to produce a realistic "glowing effect". Concrete does not generally glow with a regular gas fireplace application to yield the "glowing embers" appearance of burning wood.

Ceramic fiber is a suitable refractory material for making artificial logs, because this fiber tends to produce a "glowing effect" similar to actual burning wood. Ceramic fiber glows visibly when exposed to temperature levels approximating 1500° F. Ceramic fiber, however, is not easily formable, so it is difficult to manufacture realistic wood-like details.

Some prior art artificial fireplace logs have attempted to marry concrete and ceramic fiber into a log that will look realistic and render a "glowing effect" when heated. U.S. Pat. Nos. 5,026,579 and 5,284,686 are examples of logs that combine concrete material with ceramic fiber inserts that, through complicated processes, must be molded into cavities or otherwise attached to the concrete section(s). High temperature adhesives are suggested to accomplish the required bonding of the concrete and ceramic fiber.

The complicated bonding or molding of the concrete section and ceramic fiber in prior art patents produces problems relating to the difference of coefficients of thermal expansion and contraction. The properties of the different material undermine the integrity of the contact points between the different materials when the materials are exposed to the temperature differentials encountered in gas-burning fireplaces and stoves.

The flame of a gas-fired fireplace or stove is also an important element in obtaining a realistic wood-like looking fire. The typical "yellow flame" of a wood fire is obtained in a gas fireplace or stove through the use of a gas burner with a relatively high portion of secondary air and a smaller portion of primary air. The "yellow flame" is a fairly cold flame as opposed to the typical blue flame which is a "hot flame." Gas-fired fireplaces and stoves that use the artificial log-sets including concrete and ceramic portions have struggled with controlling the flame of the gas burner to obtain the "yellow flame" and properly heating the concrete and ceramic portions. A hot flame is required to make the ceramic fibers glow. A hot flame requires a larger portion of primary air and a smaller portion of secondary air. Thus, in order to make the ceramic fiber portions glow, an unnatural blue flame is required.

The prior art attempts to produce a medium hot flame in conjunction with ceramic fiber log portions to obtain a glowing effect of the ceramic fiber as well as a more yellow flame.

Most prior art systems utilize a single burner setup. Some utilize entire ceramic fiber log-sets combined with a medium hot flame to obtain a glowing effect as well as a more yellow flame. However, the ceramic fiber log of these systems cannot provide the same fine wood-like detail as a concrete log-set. Other systems utilize concrete log-sets with single burners, where a section of the burner is dedicated to a glowing ember section, but no glowing of any logs occurs.

SUMMARY OF THE INVENTION

The invention relates to an artificial log assembly including a ceramic fiber portion disposed between first and second concrete portions. The configuration accomplishes the important "glowing effect" by using the ceramic portion, while maintaining the realistic look of a natural firewood or a wood log with the flanking concrete sections. The ceramic portion is not coupled to either concrete log, and is not molded into grooves or sections of the concrete log. Thus, the invention requires no complicated bonding or molding or other attachment method. Further, the invention eliminates the problems resulting from the difference of the coefficients of thermal expansion and contraction.

The invention also relates to a log-set system that utilizes a dual burner setup that provides a yellow flame for the wood burning look as well as a blue flame for the glowing effect of the ceramic fiber portion. Each burner is dedicated to a specific task and has a specific shutter setting to accommodate the unique difference in flame pattern. The shutter setting for the yellow flame is more restrictive to permit more secondary air and the shutter setting for the blue flame is more open to allow more primary air.

BRIEF DESCRIPTION OF THE DRAWINGS

The features, aspects, and advantages of the invention will become more thoroughly apparent from the following detailed description, appended claims, and accompanying drawings in which:

DETAILED DESCRIPTION OF THE INVENTION

An artificial log assembly and system is described. In the following description, numerous specific details are set forth such as specific materials and forms, in order to provide a thorough understanding of the invention. It will be clear to one skilled in the art, however, that these specific details need not be employed to practice the invention.

Figure 1:
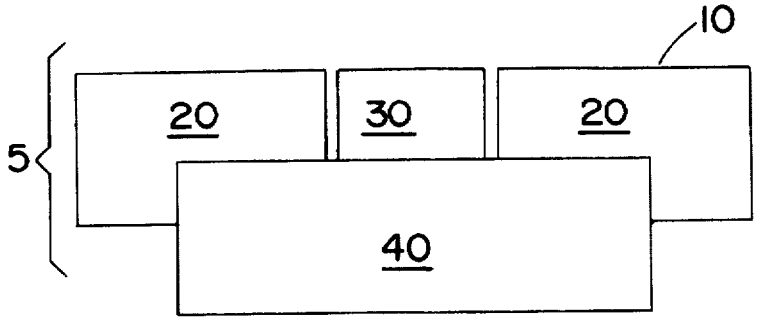
FIG. 1 is a planar front view of a block diagram of an artificial log assembly.

FIG. 1 shows a planar block diagram view of an artificial log assembly 5 that might be found in a gas-fired fireplace or stove. In FIG. 1, a pair of concrete portions 20 flank a ceramic fiber portion 30 to form an artificial log 10. The ceramic fiber portion 30 is located on the center axis of the log 10 flanked by concrete portions 20. The ceramic portion 30 is not bonded or coupled to the concrete sections 20 that flank it. Disposed directly in front of the artificial log 10 is a third concrete portion 40. The concrete portions 20 and 40 can be easily and inexpensively made to appear similar to natural firewood. Hence, the configuration shown by blocks in FIG. 1 illustrates that the ceramic fiber portion 30 is nestled between concrete portions 20 and 40. In this configuration, the concrete portions 20 and 40 may be formed to look like authentic firewood, while the ceramic portion 30 will serve to provide a "glowing effect" characteristic of natural wood.

The concrete portions 20 and ceramic portion 30 in FIG. 1 are placed together to appear like a single log 10 or a pair of logs 10 and 40. The concrete and ceramic portions of the log 10 are not held together by any bonding or molding method. Thus, if the materials expand or contract due to changes in temperature, there is no concern of damaging the coupling mechanism. Since the separate portions are not coupled, they may expand and contract freely.

The invention contemplates that the cement portions 20 are made of material including at least a portion of high temperature cement. In one embodiment, the cement portions are made of calcium aluminate cement, light weight sand, metal fibers, and shale. In another embodiment, the invention contemplates that the cement portions 20 are made of 15–25% high temperature cement and 75–85% volcanic ash aggregate.

Figure 2:
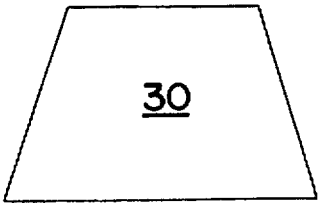
FIG. 2 is a planar top view of a ceramic portion of the artificial log assembly of the invention.
Figure 3:
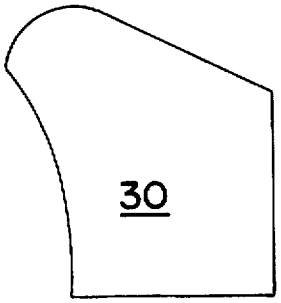
FIG. 3 is a planar side view of a ceramic portion of the artificial log assembly.
Figure 4:
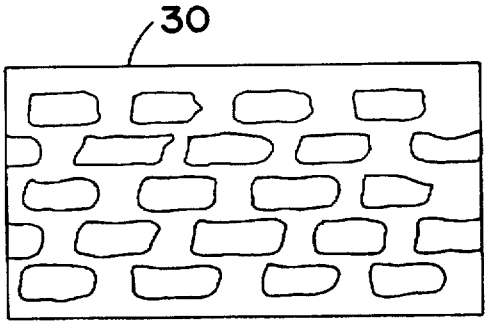
FIG. 4 is a planar front view of a ceramic portion of the invention.

FIGS. 2–4 show various views of the ceramic portion 30 contemplated for use in the artificial log assembly of the invention. The ceramic fiber portion 30 is made of a material having a thermal conductivity that is relatively low, approximating 0.090 BTU/hr Ft °F. The invention contemplates that the ceramic portion 30 glows visibly when heated above approximately 1470° F. to provide the visual effect of a burning natural log with glowing embers.

Inorganic alumina silicate fibers in an amorphous silica binder, with a thermal conductivity of 0.092 BTU/hr Ft °F., is an example of a ceramic fiber portion 30. Other ceramic fiber materials with similar properties are suitable for the invention. Specifically, one embodiment contemplates a ceramic portion of alumina silica fibers, with an alumina content of about 25–40% and a silica content of about 60–75%. Colorants may further be added to make the ceramic portion appear like a natural portion of a log. Contemplated colorants include compositions of metal oxides, e.g., $MnO_2$, CuO, $W_2O_3$, $Sn_2O_3$, $Cr_2O_3$, $TiO_2$, and $Fe_2O_3$. The colorant may comprise about 1–10% of the finished product.

FIG. 2 shows a top view of the ceramic portion 30 of the invention. In FIG. 2, the ceramic portion 30 has a trapezoid shape. FIG. 3 shows a planar side view of the ceramic portion 30. In FIG. 3, the ceramic portion 30 has a concave shape to provide increased exposed surface area for glowing. FIG. 4 illustrates a planar front view of the ceramic portion 30 wherein the front portion is molded or shaped to resemble a natural wood log.

Figure 5:
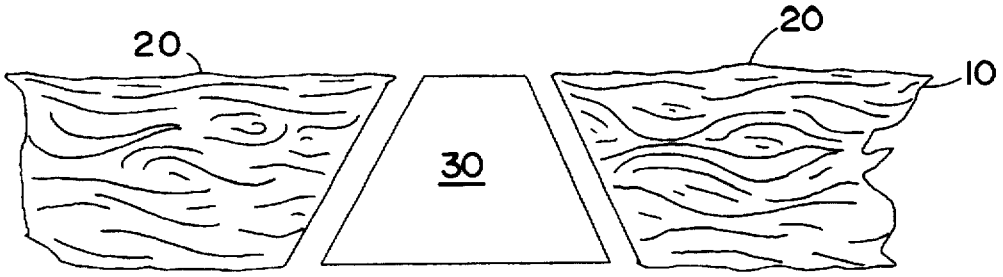
FIG. 5 is an exploded planar top view of an artificial log assembly of the invention.

FIG. 5 illustrates an exploded planar top view of an artificial log assembly 10. In FIG. 5, the artificial log assembly 10 includes a trapezoidally-shaped ceramic portion 30 flanked by a pair of concrete portions 20 that resemble natural firewood. The log assembly 10 is assembled by placing the trapezoidally-shaped ceramic portion 30 between the pair of concrete portions 20. The ceramic portion 30 lies on a horizontal axis defined by the opposing concrete portions 20. In FIG. 5, the concrete portions are made to look like natural firewood with bark, knots, and truncated limb segments, as desired. In FIG. 5, the ceramic portion 30 is not made to resemble natural wood. Alternatively, the ceramic portion 30 may be designed to resemble bark or knots on a log or simply a center portion of a log.

Figure 6:
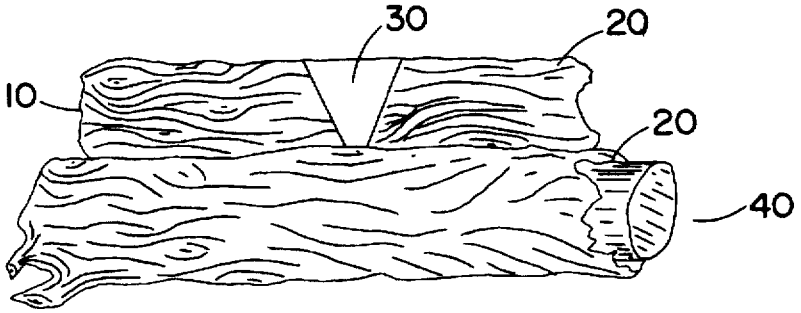
FIG. 6 is a perspective front view of a pair of log assemblies of the invention.

FIG. 6 shows a perspective front view of a pair of logs 40 and 10 of the invention. The rear log 10 contains a ceramic fiber portion 30 flanked by a pair of concrete portions 20. In FIG. 6, the concrete portions 20 are sculpted to appear like natural firewood, while the ceramic portions 30 appear unsculpted for clarity. In the preferred embodiment, the ceramic portion 30 is colored to appear similar to natural firewood. The concrete portions 20 of the rear log 10 are flanked directly adjacent to the ceramic portion 30 to give the appearance of complete logs of the composite materials.

The ceramic portion of the artificial log assembly is designed to provide a realistic "glowing effect" associated with natural firewood. It is to be appreciated that the ceramic portion may be located in any desired location on a log assembly provided a surface of the ceramic portion 30 is outwardly exposed in the gas-fired fireplace or stove in which it is used. The ceramic fiber portion or portions are preferably located in areas where there is direct flame impingement on the logs.

Figure 7:
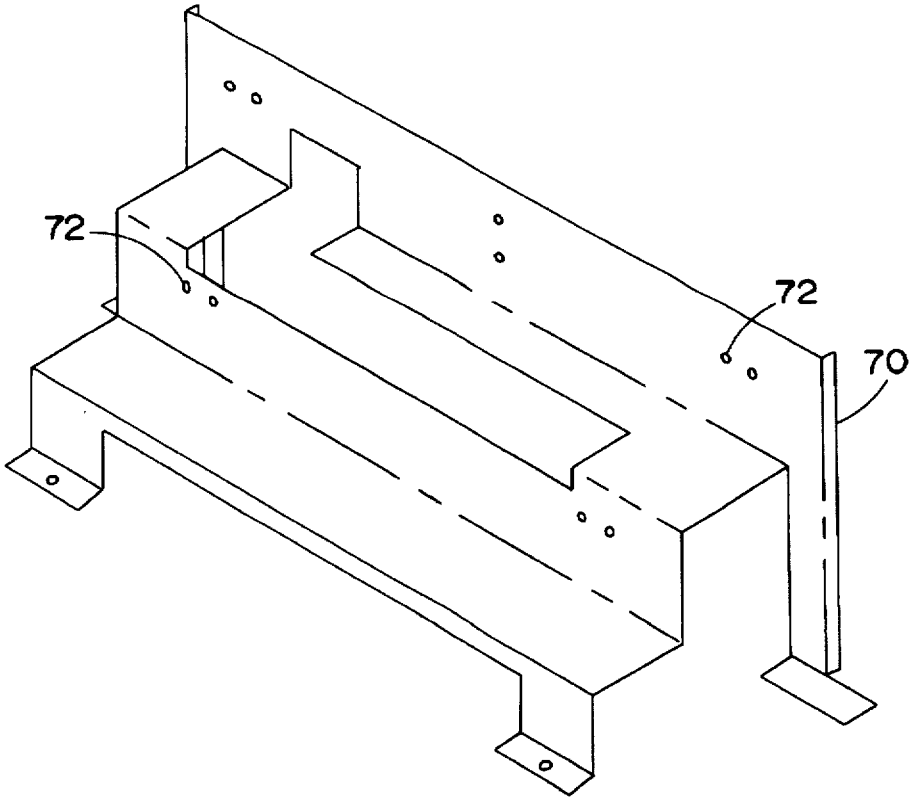
FIG. 7 is a perspective front view of a log assembly stand of the invention.

FIG. 7 is a perspective front view of a support stand 70 to support a pair of logs in a fireplace or stove. The support stand 70 includes openings 72 to provide a mounting attachment method for the logs of the support stand 70. In one embodiment, it is contemplated that the concrete portions of the artificial logs are provided with mounting wires cast in the concrete section and extending from the back of the artificial logs. The mounting wires are designed to be inserted into opening 72 of the support stand 70 so that the artificial logs may be attached by way of the wires to the support stand 70.

Figure 8A:
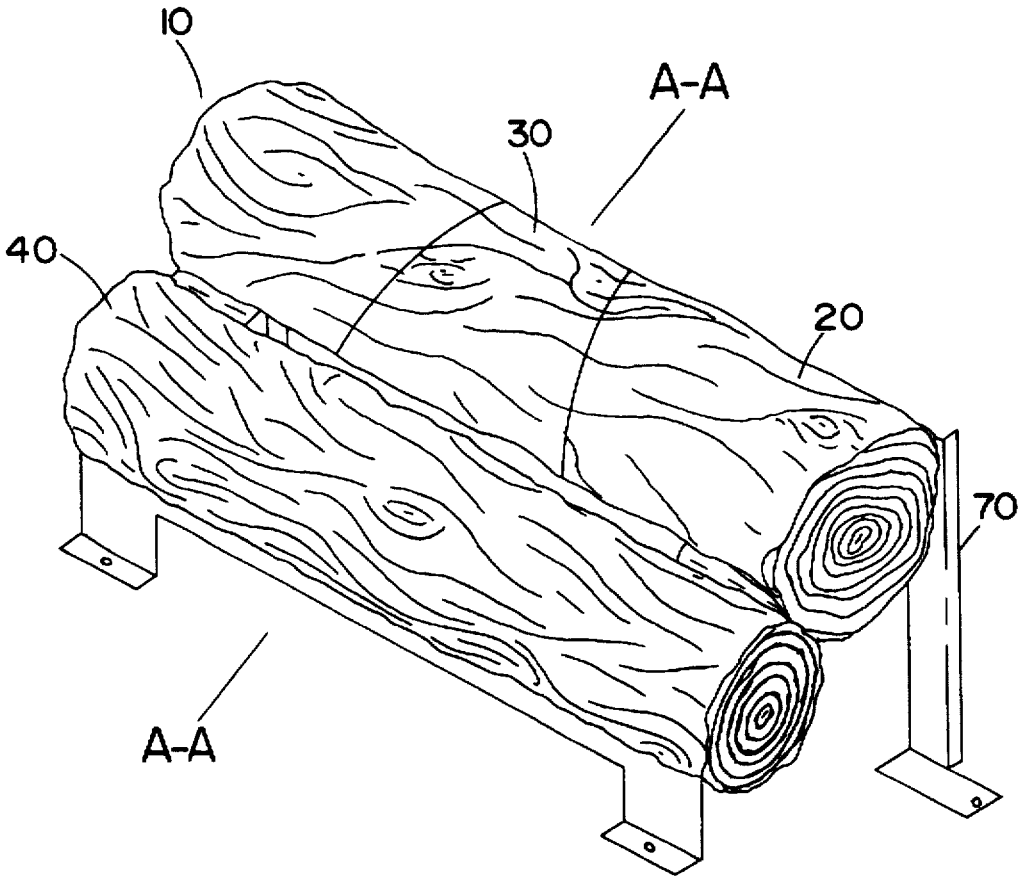
FIG. 8*a* is a perspective front view of a pair of log assemblies of the invention on a support stand.
Figure 8B:
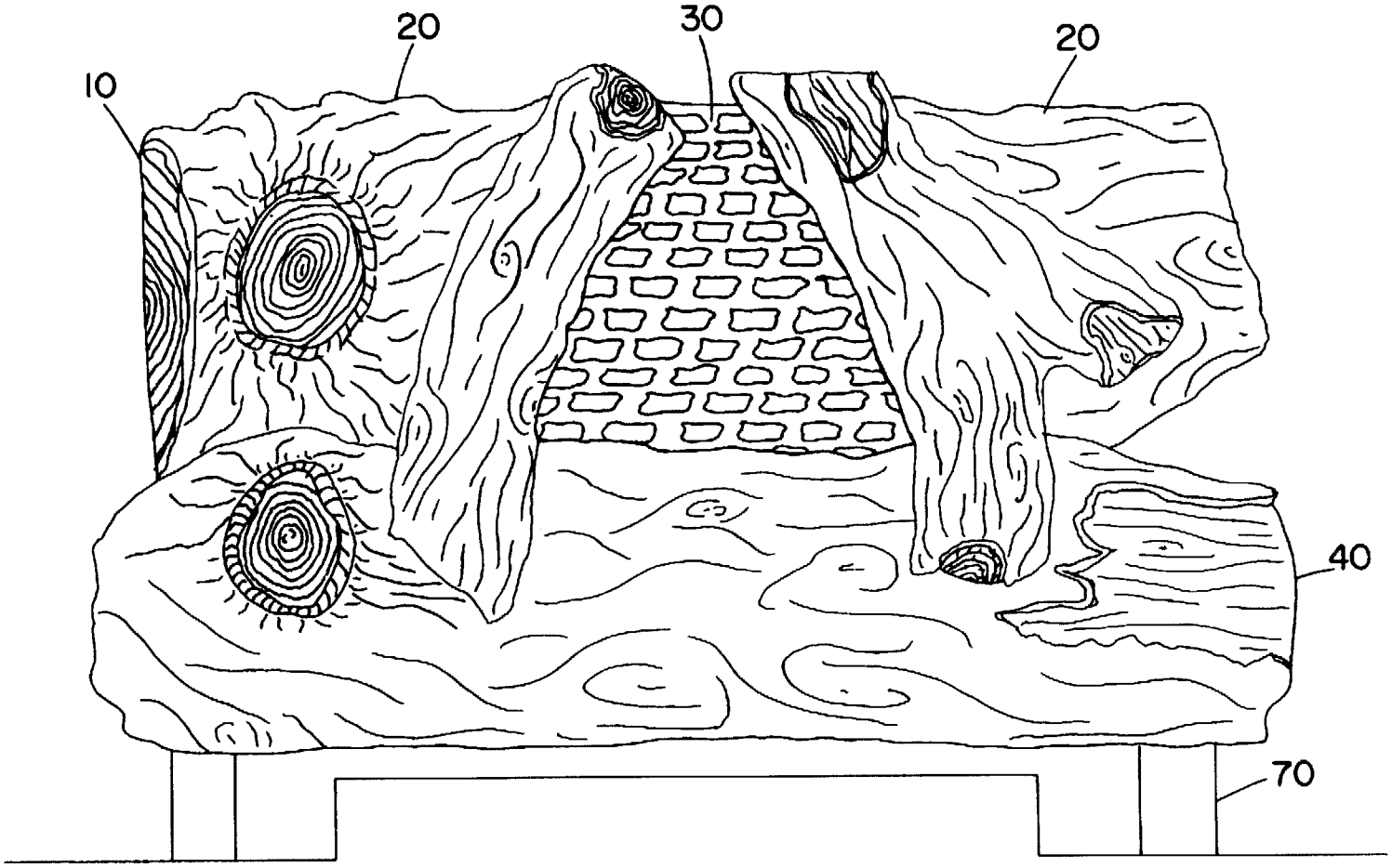
FIG. 8*b* is a planar front view of a pair of log assemblies of the invention on a support stand.

FIG. 8*a* illustrates a perspective front view of the support stand 70 supporting a pair of logs 10 and 40. The first log 40 is constructed entirely of concrete. The rear log 10 is assembled with a ceramic fiber portion 30 flanked by a pair of concrete portions 20. FIG. 8*b* illustrates a planar side view of a pair of logs in a fireplace or stove. FIG. 8*b* shows ceramic portion 30 and concrete portions 20 with the appearance of natural firewood.

Figure 9:
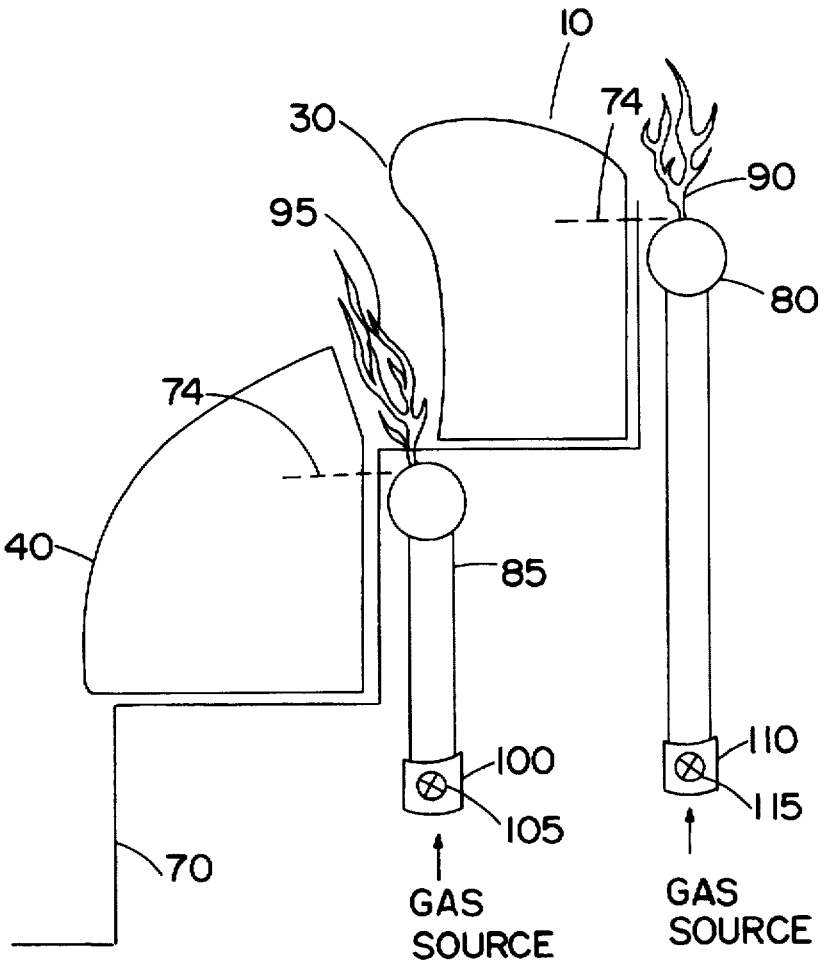
FIG. 9 is a planar side view of a pair of log assemblies on a log stand taken through line A—A of FIG. 8.

FIG. 9 is a planar side view taken through line A—A of FIG. 8*a*. A pair of logs 40 and 10 overlay a support stand 70. Each log 40 and 10 is attached to the support stand by mounting wire 74. The mounting wire 74 are cast into the concrete portions of the artificial logs and protrude out the rear side of each log.

FIG. 9 illustrates the dual gas burner system of the invention. Gas burners 80 and 85 are placed behind the logs 40 and 10 so that the burner tubing cannot be seen from the front of the fireplace or stove. The dual gas burner system of the invention contemplates that each burner 80 and 85 emits a different type of flame. For instance, the invention contemplates that burner 85 emits a "hot" or "blue" flame to heat the ceramic portion 30 of the log assembly 10. In order to produce the "glowing" effect associated with the ceramic fiber portion 30, the ceramic fiber portion must be heated to an elevated temperature (approximately above 1470° F.) achievable only with a "hot" or "blue" flame.

In the embodiment shown in FIG. 9, burner 80 is used to emit a "cold" or "yellow" flame characteristic of burning wood. This flame is generally not hot enough to heat the ceramic portion to a "glowing" state. The purpose of the yellow flame is to closely emulate the flame color of burning wood. The yellow flame 90 is typically higher or taller than the blue flame 95 emitted by gas burner 85 since the yellow flame is the most predominant or visible flame. The height of the flames 90 and 95 is controlled by a gas flow regulation valve, port diameters, and air shutter setting. The gas burner 80 produces yellow flames across the length of the log assembly to give a realistic effect to the gas-burner fire.

The type of flame produced by burners 80 and 85 is determined by regulating the fuel/air mixture to the flame. One way this is done is by adding air shutters 100 and 110 to the respective burners 85 and 80 to allow primary air to mix with the fuel. The amount of primary air that is allowed to mix with the fuel by way of the air shutters 105 and 115 is controlled by manually operated air control valves 105 and 115. More primary air is needed for a hot or blue flame than for a cold or yellow flame. The precise amount of air/fuel mixture needed to produce the desired flame characteristics can be determined by visual inspection and is known by those of ordinary skill in the art.

Figure 10:
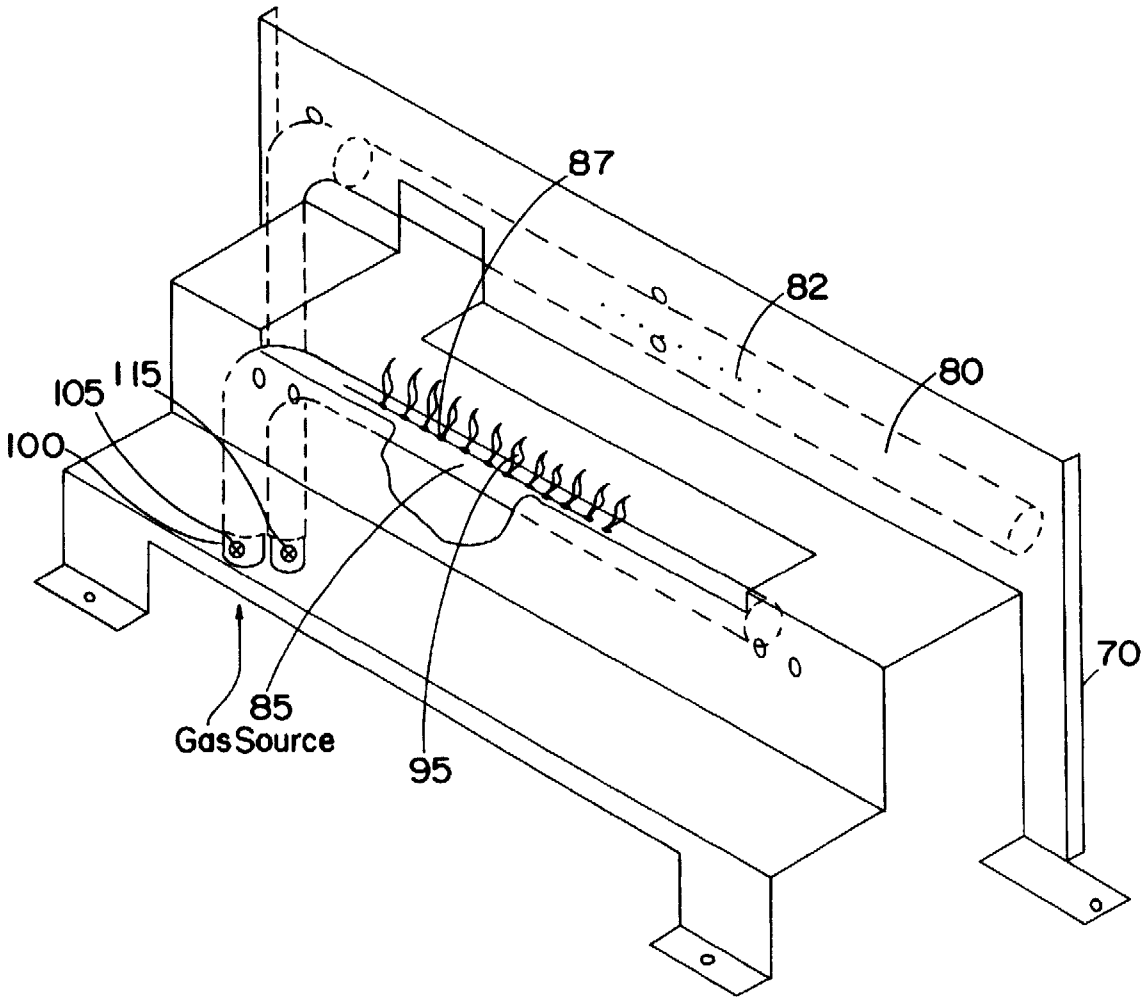
FIG. 10 is a perspective front view of a support stand with dual gas burners.

FIG. 10 illustrates a front perspective view of the support stand 70 with dual gas burners 80 and 85 shown in shadow or dotted lines behind the support stand. A portion of the support stand 70 is cut away to illustrate the burner 85. Burner 80 contains ports 82 that support a flame. Burner 85 also includes ports 87 to support a flame 95. The amount of primary air supplied to each gas burner 80 and 85 is regulated by air control valves 105 and 115, respectively, to control the gas supply associated with the flame. Each gas burner 80 and 85 is further connected to a main gas source, e.g., a natural gas or propane gas source.

In the preceding detailed description, the invention is described with reference to specific exemplary embodiments thereof. It will, however, be evident that various modifications and changes may be made thereto without departing form the broader spirit and scope of the invention as set forth in the claims. The specification and drawings are, accordingly, to be regarded in an illustrative rather than a restrictive sense.

What is claimed is:

1. An artificial log assembly comprising:

a first concrete portion and a second concrete portion; and a ceramic portion having a first side portion and a second side portion, the first concrete portion adjacent and non-fixedly disposed to the first side portion of the ceramic portion and the second concrete portion adjacent and non-fixedly disposed to the second side portion of said ceramic portion.

2. The artificial log assembly of claim 1, wherein the placement of the first and second concrete portions defines an axis and wherein the ceramic portion is disposed on the axis.

3. The artificial log assembly of claim 1, wherein the ceramic portion has an exposed outer surface.

4. The artificial log assembly of claim 1 further comprising a third concrete portion adjacent to the ceramic portion and the first and second concrete portions.

5. The artificial log assembly of claim 1, wherein the ceramic portion has a thermal conductivity of approximately 0.09 BTU/hr Ft°F.

6. The artificial log assembly of claim 1, further comprising:

a first gas burner disposed adjacent to the first and second concrete portions;

means to control a flame produced by the first gas burner;

a second gas burner disposed adjacent to the ceramic portion; and means to control a flame produced by the second gas burner.

7. The artificial log assembly of claim 6, wherein the second gas burner produces a hotter flame than a flame produced by the first gas burner.

8. The artificial log assembly of claim 1, wherein the first concrete portion and the second concrete portion further each comprise a mounting means.

9. The artificial log assembly of claim 8, further comprising a support stand wherein the first concrete portion, the second concrete portion, and the ceramic portion are disposed on the support stand and wherein the mounting means of the first concrete portion is coupled to the support stand and the mounting means of the second concrete portion is coupled to the support stand.

10. A process of assembling artificial logs in a fireplace or stove, comprising:

placing a first concrete portion and a second concrete portion in the fireplace or stove; and placing a ceramic portion having a first side portion and a second side portion between the first and second concrete portions such that the first concrete portion is non-fixedly disposed adjacent the first side portion and the second concrete portion is non-fixedly disposed adjacent the second side portion.

11. The process of claim 10, wherein the placement of the first and second concrete portions defines an axis and wherein the ceramic portion is placed on the axis.

* * * * *